United States Patent [19]

Gilgore

[11] 4,142,462

[45] Mar. 6, 1979

[54] HALFTONE PRINTING METHOD

[75] Inventor: Wayne M. Gilgore, Cornwall-on-Hudson, N.Y.

[73] Assignee: International Paper Company, New York, N.Y.

[21] Appl. No.: 795,931

[22] Filed: May 11, 1977

[51] Int. Cl.[2] ..... B41M 1/20; B41F 17/28

[52] U.S. Cl. ..... 101/38 R; 101/211

[58] Field of Search ..... 101/211, 38 R, 40, 181

[56] References Cited

U.S. PATENT DOCUMENTS

| | | | |
|---|---|---|---|
| 714,953 | 12/1902 | Rudometoff | 101/211 |
| 930,689 | 8/1909 | Rheinberg | 101/211 X |
| 3,195,451 | 7/1965 | Hovekamp et al. | 101/38 R |
| 3,381,612 | 5/1968 | Lecha | 101/211 X |
| 3,398,678 | 8/1968 | Usko | 101/38 R |
| 3,948,171 | 4/1976 | O'Connell | 101/40 |
| 3,977,318 | 8/1976 | Cohan | 101/181 |

*Primary Examiner*—Clyde I. Coughenour

*Attorney, Agent, or Firm*—Robert R. Jackson; Stephen P. Gilbert

[57] ABSTRACT

Distortion, smearing, and/or slurring are reduced in printing halftone images using printing apparatus with cylindrical printing surfaces by forming the image to be printed as a plurality of toned lines substantially perpendicular to the ink transfer nips in the printing apparatus. The invention is particularly suited to printing halftone images on rough or irregular substrates and on substrates, such as the outer side surfaces of truncated conical containers, which are not of uniform conformity with the cylindrical printing surface.

7 Claims, 9 Drawing Figures

HALFTONE PRINTING METHOD

BACKGROUND OF THE INVENTION

This invention relates to printing methods, and more particularly to methods for printing halftone images on substrates having irregular surfaces and/or surfaces which are not of uniform conformity with the printing surface. This invention also relates to printing halftone images with apparatus in which high pressure is required for any reason at any ink transfer nip, and apparatus in which overinking is a problem. The invention has particular application to printing halftone images around truncated conical substrate surfaces such as the outer side surfaces of plastic containers.

Printing presses with cylindrical printing members have been adapted for printing on the outer side surfaces of plastic containers (e.g., cups) which have the shape of a truncated cone. In one common arrangement the already formed container is mounted on a rotatable mandrel and held so that the outer side surface of the container is in line contact with the cylindrical surface of the printing member. The printing member rotates about its longitudinal axis, thereby rotating the container and transferring ink from the printing surface to the container at the line contact or nip between the surfaces. Because the printing surface is cylindrical and the container surface has a truncated conical shape, the container surface is not uniformly conformable to the printing surface. Typically, the upper portion of the container, which has the larger circumference, has a higher linear velocity than the adjacent printing surface. The lower portion of the container, which has the smaller circumference, has a lower linear velocity than the adjacent printing surface. Only at some intermediate portion of the container is the linear velocity of the container surface the same as the linear velocity of the adjacent printing surface. Accordingly, the container surface is generally overfed near the top of the container and underfed near the bottom of the container. This causes circumferential elongation of the portion of the image near the top of the container and circumferential foreshortening of the image near the bottom of the container. Only the intermediate portion of the image is printed without distortion.

Not only are portions of the image distorted as described above, they are also frequently smeared or slurred. For example, the overfeeding of the top portion of the container surface tends particularly to slur the trailing edge of each feature of the image on that portion of the container.

Many printing substrates have localized non-uniformities which interfere with image transfer to them. For example, the wall thickness of thermoformed or molded plastic containers typically varies considerably. To insure good ink transfer to the container surface despite these surface variations or irregularities, substantial pressure is required between the printing surface and the container. Similar high pressure is required for satisfactory ink transfer to many other possible substrate materials with irregular surfaces such as corrugated cardboard, high basis weight cardboard, wood, nonwoven fabrics, kraft paper, polyethylene coated paper, and textured or embossed substrates such as embossed plastic film. Wherever such high pressure is required for good ink transfer, increased smearing or slurring of the printed image is frequently experienced.

Depending on the type of printing process involved, high pressure at ink transfer nips other than the nip at which the image is finally transferred to the substrate may also cause smearing or slurring of the printed image. In old or worn presses, high pressure may be required between the inking roller and the image cylinder to insure thorough inking of the image despite worn bearings, irregular surfaces, etc. If the image or plate cylinder is not used as the printing surface, the image must be transferred from the plate cylinder to a blanket cylinder which is then the printing surface. Again, high pressure may be required between the plate cylinder and the blanket cylinder for good image transfer to the blanket cylinder despite worn or irregular parts. High pressure at any of these ink transfer nips tends to cause slurring of the transferred image so that the final printed image is similarly slurred.

Overinking, which may occur occasionally in any printing operation and which is particularly common in old or worn presses, is another frequent cause of image smearing or slurring.

All of the foregoing problems are particularly aggravated in attempting to print small image details. Halftone images are made up entirely of small image elements and are therefore extremely difficult to print under the conditions described above. Image distortion of the kind encountered in printing or truncated conical surfaces such as plastic containers makes it very difficult to achieve uniform image density vertically on the finished container. The halftone image tends to be lighter or less dense than desired near the top of the finished container and darker or more dense than desired near the bottom of the container. Smearing or slurring of the image as a result of any or all of the above factors (i.e., non-uniform conformity of the substrate with the printing surface such as is experienced with conical containers, high pressure at any ink transfer nip, and/or overinking) also interferes with good halftone printing. The halftone dots are distorted by the slurring, thereby degrading the image. A small amount of distortion of each halftone dot has a large cumulative effect on the overall image. Intended levels of shading cannot be maintained and contrast may be lost. If the slurring is severe enough, the halftone dots may run together with the result that image details are completely lost.

All of the foregoing problems become even more severe in printing multicolor halftone images in which several monochromatic halftone images must be superimposed in proper registration and with proper density to achieve the desired composite result.

In view of the foregoing, it is an object of this invention to provide improved methods for printing halftone images on substrates having irregular surfaces and/or surfaces which are not of uniform conformity with the printing surface.

It is a more particular object of this invention to provide improved methods for printing halftone images on the outer side surfaces of truncated conical thermoformed or molded plastic containers.

It is another more particular object of this invention to provide improved methods for printing halftone images in any application in which high pressure is required at any ink or image transfer nip, or in which overinking is a frequent problem.

SUMMARY OF THE INVENTION

These and other objects of the invention are accomplished in accordance with the principles of the invention by forming the image as a plurality of parallel toned lines substantially perpendicular to the nip between the printing surface and the substrate surface. The master or plate is prepared using a line screen (rather than the usual halftone dot screen) with the lines oriented substantially parallel to the printing direction. The plate then has an image made up of a plurality of toned lines substantially parallel to the printing direction and therefore substantially perpendicular to all of the ink transfer nips in the printing apparatus. The printing apparatus is operated in the conventional way to print images which are also made up of toned lines substantially parallel to the printing direction and therefore substantially perpendicular to the nip between the printing surface and the substrate surface.

Multicolor halftone images are formed by superimposing monochromatic partial images, each of which is formed as a plurality of parallel toned lines having a unique angular orientation as nearly perpendicular to the nip between the printing and substrate surfaces as is consistent with preventing moire in the printed image. Preferably, the lines forming the monochromatic partial image of the most important color are substantially perpendicular to the nip between the printing and substrate surfaces, and the lines forming other partial images deviate from perpendicular in inverse relation to their importance to the appearance of the final image.

Halftone images printed in accordance with the principles of this invention on such surfaces as truncated conical containers are less degraded by the lack of conformity of the printing and substrate surfaces than conventional halftone dot images. Most of the slurring occurs along the toned lines and therefore has much less effect on the appearance of the image. The method of this invention also reduces the effect of smearing or slurring due to overinking or high pressure at any ink transfer nip. Again, most of the smearing or slurring occurs along the toned lines and therefore has less effect on the appearance of the image.

Further features of the invention, its nature and various advantages will be more apparent from the accompanying drawing and the following detailed description of the invention.

Figure 4:
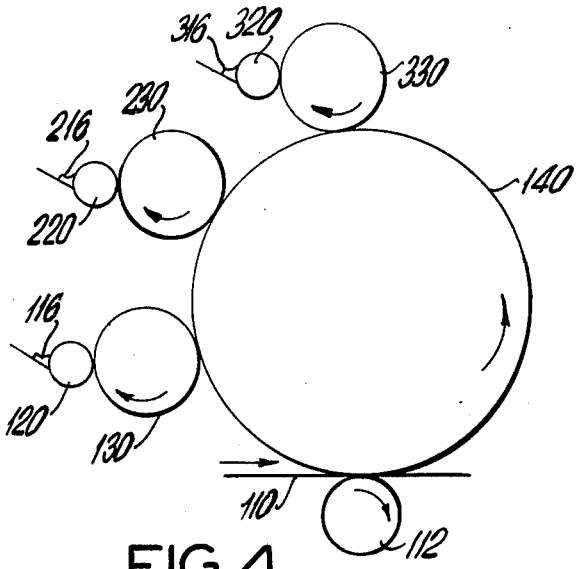
Figure 5:
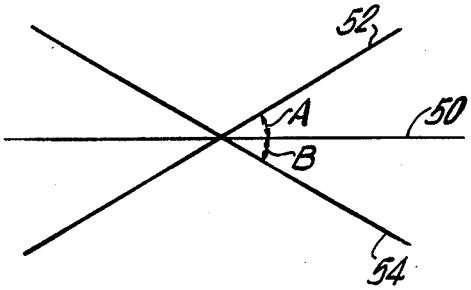
Figure 6:
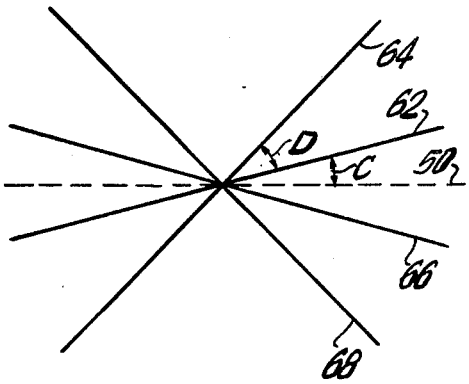

FIGS. *3a–3d* are greatly enlarged representations of toned dots and lines useful in understanding the principles and advantages of the invention;

FIG. 4 is an elevational view of greatly simplified apparatus for printing multicolor images on cut substrate sheets; and FIGS. 5 and 6 show how the toned lines of each of several monochromatic halftone images can be oriented in accordance with the principles of the invention.

DETAILED DESCRIPTION OF THE INVENTION

Figure 1:
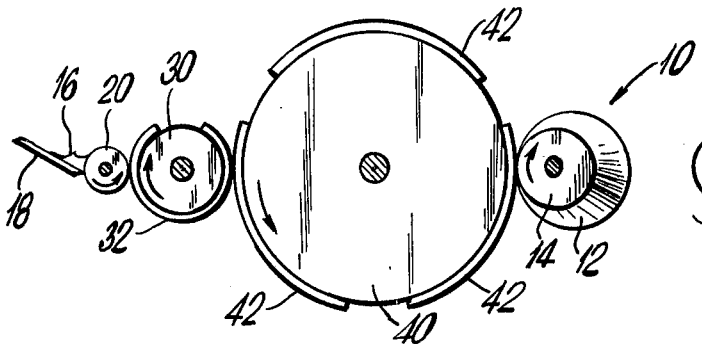
FIG. 1 is an elevational view of greatly simplified apparatus for printing on the side surfaces of truncated conical containers.
Figure 2:
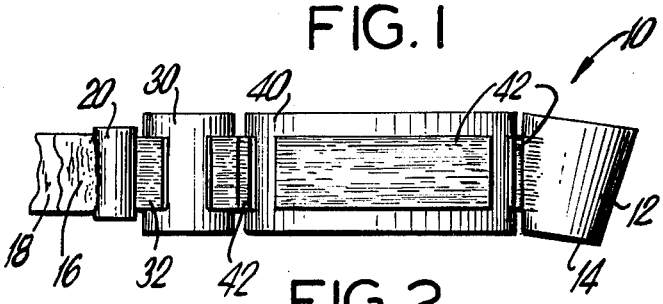
FIG. 2 is a plan view of the apparatus of FIG. 1.

As shown in FIGS. 1 and 2, a typical arrangement for printing on the outer side surface 12 of truncated conical container 10 includes inking roller 20, plate cylinder 30, and blanket cylinder 40. Each of elements 20, 30, and 40 rotates about its central axis in the direction indicated by the associated arrow. The central axes of all of these elements are parallel, and all have the same surface velocity. Container 10 is mounted on a mandrel (not shown) having a central axis of rotation which intersects the axis of rotation of blanket cylinder 40. Container 10 is typically a plastic material which has been formed by any conventional method. For example, container 10 may have been thermoformed by any of several processes such as vacuum forming, pressure forming, plug assist forming, matched tool forming or the like. Alternatively, container 10 may have been molded by such processes as blow molding or injection molding. Container 10 may also have been formed by a hybrid of the above processes such as in a Hayssen monaformer.

Plate cylinder 30 has a master or plate 32 mounted on the periphery thereof. (The thickness of plate 32 is greatly exaggerated for purposes of illustration in FIGS. 1 and 2.) The image on plate 32 is inked by contact with inking roller 20. Inking roller 20 is inked in turn from an ink supply. In the simplified apparatus of FIGS. 1 and 2 inking roller 20 is inked from ink supply 16 maintained between a portion of the surface of roller 20 and doctor blade 18, although in actual practice inking roller 20 is typically inked by a more sophisticated arrangement (e.g., an ink train including a plurality of rollers for forming a uniform film of ink or inking roller 20). The inked image on plate 32 is transferred by contact to one of blankets 42 on the periphery of blanket cylinder 40. (Again, the thickness of blankets 42 is greatly exaggerated in FIGS. 1 and 2.) Finally, the image on one of blankets 42 is transferred by contact to the side surface 12 of container 10. When a complete image has been printed on container 10 (i.e., when one of blankets 42 has rotated past container 10 and container 10 has accordingly been driven through approximately one revolution), container 10 is moved away from contact with blanket cylinder 40 and another container is moved into its place in time to receive an image from the next successive blanket 42. While container 10 is in contact with blanket cylinder 40, it is driven about its axis by contact with cylinder 40.

As is apparent from the foregoing, ink is transferred from inking roller 20 to plate 32 at the nip between inking roller 20 and plate cylinder 30. Similarly, an inked image is transferred from plate 32 to successive blankets 42 at the nip between plate cylinder 30 and blanket cylinder 40. An inked image is also transferred from one of blankets 42 to container surface 12 at the nip between blanket cylinder 40 and container 10.

Although a particular printing arrangement is shown for illustrative purposes in FIGS. 1 and 2, it will be understood that any other printing apparatus can be used in which an image is transferred from a printing surface to a substrate surface at a line contact (nip) between the surfaces. For example, blanket roller 40 could be omitted and the image printed directly on container 10 from plate cylinder 30. In that case, plate 32 would be the printing surface.

Because container 10 has the shape of a truncated cone, the circumference of container 10 is less near the bottom 14 of the container than near the top of the container. Accordingly, the top portion of container surface 12 has greater linear velocity than the bottom portion of that surface. This generally means that as blanket cylinder 40 drives container 10, the top portion of container surface 12 moves somewhat faster than the adjacent portion of blanket 42, the bottom portion of container surface 12 moves somewhat slower than the adjacent portion of blanket 42, and only an intermediate portion of container surface 12 moves at the same speed as the adjacent portion of blanket 42. This means that only the intermediate portion of the image will be printed on the container without distortion, slurring, or smearing. The distortion, slurring, or smearing of the remainder of the image can seriously degrade the appearance of the printed image, particularly a halftone dot image wherein the distortion, slurring, and/or smearing of each dot has a large cumulative effect on the overall appearance of the image.

In accordance with the principles of this invention, halftone images are printed by means of toned line images rather than toned dot images, the toned lines being oriented substantially perpendicular to the nip between the blanket cylinder (or other printing surface) and the container surface (or other substrate surface) to greatly reduce the deleterious effects of the distortion, slurring, and smearing described above. This is accomplished in the printing arrangement shown in FIGS. 1 and 2 by forming a halftone image on plate 32 comprised of a plurality of parallel toned lines substantially perpendicular to the ink transfer nip between plate cylinder 30 and blanket cylinder 40. Because plate 32 is wrapped around the cylindrical surface of plate cylinder 30, it will be understood that the toned lines on plate 32 are said to be "perpendicular" or "substantially perpendicular" to the ink transfer nip between cylinders 30 and 40 with reference to a line perpendicular to this ink transfer nip which has been wrapped around the cylindrical surface of plate cylinder 30. This "wrapped" perpendicular line lies in a plane perpendicular to the ink transfer nip. "Perpendicular" and "substantially perpendicular" have the same meaning when applied to toned lines on any other cylindrical surface. In FIG. 2, plate 32 is shaped with lines perpendicular to the nip between cylinders 30 and 40, although the scale of FIG. 2 is too small to illustrate how these lines form an image.

The parallel toned lines forming the image on plate 32 need not be exactly perpendicular to the nip between cylinders 30 and 40, but may deviate somewhat from perpendicular. Preferably, the angle between the toned lines and a perpendicular is no more than 30°, and more preferably no more than 15°. These angles are measured on the cylindrical surface of plate cylinder 30 (or any other pertinent cylindrical surface).

The toned lines are actually formed on plate 32 by any conventional technique. For example, if plate 32 is made photographically, the necessary toned line image can be made by using a line screen having the desired orientation of screen lines, rather than the usual dot screen. In all other respects, the photographic process of making plate 32 may be the same as when a dot screen is used. Suitable photographic techniques for making plate 32 are described in "The Contact Screen Story by Du Pont", E. I. Du Pont De Nemours & Company (Inc.), Photo Products Department, Wilmington, Delaware 19898, Publication A-80172, March 1972. Suitable straight line screens are described on page 41 of this publication, and an enlarged straight line screen is illustrated on that page. Typically, the toned line image has from about 55 to about 150 toned lines per inch measured perpendicular to the toned lines.

Plate 32 is repeatedly inked in the usual manner and the inked image is transferred by contact to successive blankets 42 on blanket cylinder 40. Like the original plate image, the inked images on blankets 42 are comprised of parallel toned lines substantially perpendicular to the nip between plate cylinder 30 and blanket cylinder 40, and therefore also substantially perpendicular to the nip between blanket cylinder 40 and container surface 12.

Finally, the inked image on one of blankets 42 is transferred by contact to container surface 12. Because the printed image is made up of lines substantially perpendicular to the nip between blanket cylinder 40 and container surface 12, substantially all of the distortion, slurring, and/or smearing which occurs is along the toned lines and therefore has much less effect on the appearance of the printed image than in comparable halftone dot images.

Figure 3A:
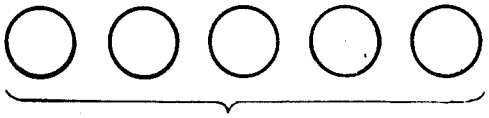
Figure 3B:
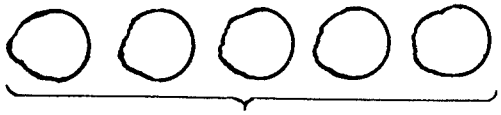

FIGS. 3*a–d* illustrate in a very general and simplified manner why beneficial results are achieved in accordance with the principles of this invention. FIG. 3*a* shows a single row of greatly enlarged halftone dots to be printed on container surface 12 perpendicular to the ink transfer nips in the printing apparatus. It is assumed that this row of halftone dots is to be printed on a portion of container surface 12 in which smearing or slurring of the image is likely to occur. FIG. 3*b* shows how the row of halftone dots of FIG. 3*a* is actually printed on container surface 12. Instead of the nearly circular dots shown in FIG. 3*a*, each dot in FIG. 3*b* is slightly smeared or slurred, mostly in the direction of printing (i.e., perpendicular to the ink transfer nips). The slight smearing or slurring of each dot has a relatively large cumulative effect on the printed image. For example, if 10% is added to the area of each dot as a result of smearing or slurring, the printed image will be approximately 10% denser or darker than intended. Larger amounts of smearing or slurring have an even greater effect on the appearance of the printed image.

Figure 3C:
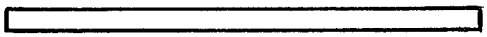
Figure 3D:
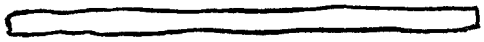

FIG. 3*c* shows a single toned line to be printed on container surface 12 perpendicular to the ink or image transfer nips under the same conditions as in FIGS. 3*a* and 3*b*. FIG. 3*d* shows how the toned line of FIG. 3*c* is actually printed on container surface 12. Again, the printed image is somewhat smeared or slurred in the direction of printing. However, only a relatively small area is added to the line as a result of this smearing or slurring. Much of the smeared or slurred ink remains within the intended area of the line and only a small amount is smeared beyond the intended end of the line. Accordingly, much less than 10% is added to the area of the line and the effect on the printed image is much less severe than with toned dots printed under similar conditions.

Although the smearing or slurring described above is the result of the non-uniform conformity of the printing and substrate surfaces (i.e., the use of a cylindrical blanket to print on a truncated conical container), use of the method of this invention also reduces the effects on printed halftone images of smearing or slurring due to other factors such as overinking and/or high pressure at any of the ink transfer nips. Overinking causes conventional halftone dots to spread out in all directions, but especially in the direction of printing. If the overinking is substantial, the dots may spread out so that they meet and begin to fill in the intermediate areas. The result is loss of detail, tone, and contrast. Overinking may occur accidentally in any printing operation and is a frequent problem in old or worn presses in which the inking apparatus is difficult to adjust and control.

High pressure at one or more ink transfer nips (e.g., the ink transfer nip between inking roller 20 and plate cylinder 30 in the apparatus of FIGS. 1 and 2, or the image transfer nips between plate cylinder 30 and blanket cylinder 40 and between blanket cylinder 40 and container surface 12) affects conventional halftone images in much the same way that overinking does. As in the case of overinking, high pressure ink transfer causes the halftone dots to spread out, thereby altering the intended image density and possibly causing loss of detail, tone, and contrast. High pressure is typically required for good image transfer to irregular substrate surfaces such as the walls of thermoformed or molded plastic containers, corrugated cardboard, high basis weight cardboard, wood, non-woven fabrics, kraft paper, polyethylene coated paper, and textured or embossed substates such as embossed plastic film. As used herein, the term "high pressure" in this context means a "squeeze" of 0.006 inch or more (i.e., maximum total deformation of opposing surfaces at the ink or image transfer nip of 0.006 inch or more), and especially a squeeze of 0.006 to 0.060 inch. Ordinary printing on regular substrate surfaces such as printing quality papers does not normally require such high pressures. A squeeze of 0.004 inch or less is generally sufficient for good printing on the usual grades of paper. However, high pressure as that term is defined above may even be required for satisfactory image transfer to ordinary paper if the press is old or worn. High pressure may also be required at ink transfer nips other than the final image transfer nip in old or worn presses.

Use of a toned line image having lines substantially perpendicular to the ink transfer nips in accordance with the method of this invention (instead of a conventional halftone dot image) substantially reduces the deleterious effects of overinking and/or high pressure ink transfer. Most of the smearing of ink occurs in the direction of printing, i.e., along the toned lines, and therefore has relatively little effect on the appearance of the printed image. Also, for a given density, the lateral spacing between the boundaries of adjacent toned lines is somewhat greater than the lateral spacing between the boundaries of adjacent rows of toned dots. Accordingly, lateral spreading of ink due to overinking and/or high pressure is less likely to cause adjacent toned lines to run together than adjacent rows of toned dots.

The principles of this invention are also applicable to printing multicolor halftone images made up of two or more partial monochromatic images. If the partial images do not overlap, each partial image is printed in the same way that a single monochromatic image is printed, i.e., the parallel toned lines forming each partial image are oriented substantially perpendicular to the ink transfer nips in the printing apparatus. If the partial images overlap to provide mixtures of the colors of the partial images, the toned lines of each partial image must have a unique angular orientation sufficiently different from the angular orientation of the lines of all other partial images to prevent moire and achieve uniform blending of the colors in the printed image. In general, the angular difference between the lines of each partial image must be at least 30° to prevent moire (although for colors with low visible contrast to the background, such as yellow on a white background, the angular difference may be substantially less than 30° (e.g., 15°) because the prevention of moire is less critical for such colors). On the other hand, the lines of all partial images are preferably as nearly perpendicular to the ink transfer nips in the printing apparatus as is consistent with preventing moire to reduce the adverse effects of smearing and slurring described above. Thus, the lines of all the partial images preferably deviate from perpendicular to the ink transfer nips by no more than 45°, more preferably by no more than 30°.

FIG. 4 illustrates apparatus for printing a three-color image on cut substrate sheets. Each of plate cylinders 130, 230, and 330 is provided with a plate for a respective one of three monochromatic partial images. Each of these plates is inked with ink of the appropriate color by a separate inking roller 120, 220, 320, each supplied with ink from an associated ink supply 116, 216, 316. The inked partial images are transferred in proper registration from plate cylinders 130, 230, and 330 to form a composite image on blanket cylinder 140. This composite image is then printed on cut substrate sheet 110 which passes between blanket cylinder 140 and pressure cylinder 112 at the appropriate time to receive the image.

Although in the apparatus shown in FIG. 4, the monochromatic partial images are superimposed on blanket cylinder 140 and the resulting composite transferred to substrate 110, it will be understood that three separate printing surfaces could be used to successively print the three partial images in proper registration on the substrate. Similarly, although the apparatus of FIG. 4 is capable of printing a three-color image, plate cylinders can be added or deleted to print images having more or less than three colors. The apparatus shown in FIG. 4 can alternatively be used to print multicolor halftone images on truncated conical containers by holding the container against blanket cylinder 140 as in the apparatus of FIGS. 1 and 2.

Assuming that the multicolor image to be printed by apparatus of the type shown in FIG. 4 is one in which the monochromatic partial images are at least partially overlapping to provide mixtures of colors, FIG. 5 illustrates how the lines forming each of the three partial images may be oriented in accordance with the principles of this invention to prevent moire in the printed image and achieve uniform blending of colors, while at the same time reducing the effects of slurring and smearing described above. In FIG. 5, line 50 is perpendicular to the ink transfer nips in the printing apparatus. The toned lines forming one monochromatic partial image are oriented parallel to line 50. The toned lines forming a second partial image are oriented parallel to line 52 which deviates from perpendicular line 50 by an angle A. Angle A is preferably in the range from 30° to 45°, more preferably about 30°. The toned lines forming the third partial image are oriented parallel to line 54 which deviates from perpendicular line 50 (in the opposite angular direction from line 52) by an angle B. Like angle A, angle B is preferably in the range from 30° to 45°, more preferably about 30°.

FIG. 6 shows how the toned lines of four monochromatic partial images may be oriented in accordance with the invention. As in FIG. 5, the line 50 is perpendicular to the ink transfer nips. Line 62 deviates from perpendicular line 50 by an angle C. Angle C is preferably about 15°. The toned lines of a first partial image are oriented parallel to line 62. Line 64 deviates further from perpendicular line 50, forming an angle D with line 62. Angle D is preferably about 30°. The sum of angles C and D is preferably no more than 45°. The toned lines of a second partial image are oriented parallel to line 64. Lines 66 and 68 deviate from perpendicular line 50 by angles which are preferably equal to but opposite from the angles of deviation of lines 62 and 64, respectively. The toned lines of third and fourth partial images are oriented parallel to lines 66 and 68, respectively.

The foregoing examples are illustrative only, and it will be understood that any orientations within the ranges set forth above may be chosen for the toned lines of the monochromatic partial images forming a multicolor printed image. If one or more partial images are more important to the printed image than other partial images (e.g., if the appearance of the printed image is more seriously affected by smearing or slurring of one or more partial images than by smearing or slurring of other partial images), the partial images are preferably oriented so that the deviation from perpendicular is inversely related to the importance of the partial image. In the arrangement illustrated by FIG. 5, for example, the most important partial image would be formed by lines parallel to line 50, and the less important partial images would be formed by lines parallel to lines 52 and 54. Similarly, in the arrangement shown in FIG. 6, the more important partial images would be formed by lines parallel to lines 62 and 66, and the less important partial images would be formed by lines parallel to lines 64 and 68.

It will be understood that the foregoing is illustrative of the principles of this invention only, and that various modifications may be made by those skilled in the art without departing from the scope and spirit of the invention. For example, the method of the invention may be carried out on various types of printing devices as discussed above.

I claim:

1. A method for printing a multicolored halftone image on a truncated conical substrate surface wherein said image comprises at least two distinctly colored overlapping partial images and wherein each partial image comprises a plurality of similarly-toned parallel lines, comprising (a) forming each partial image on a cylindrical printing surface so that the lines of each partial image are at a unique angle of no more than 45° with a line perpendicular to the nip between the substrate surface and the respective printing surface, the parallel lines of one partial image being substantially perpendicular to the nip and the angle associated with each partial image being sufficiently different from the angle associated with any other partial image so as to prevent moire; and (b) transfering each partial image from the respective printing surface to the truncated conical substrate surface at the nip between the substrate surface and the respective printing surface.

2. The method of claim 1 wherein each partial image comprises from about 55 to about 150 parallel toned lines per inch.

3. The method of claim 1 wherein the angle associated with each partial image is about 30° different from the angle associated with any other partial image.

4. The method of claim 1 wherein the toned lines of each partial image form a unique angle of no more than 30° with the line perpendicular to the nip between the substrate surface and the respective printing surface.

5. The method of claim 1 wherein all partial images are formed on the same printing surface before being transfered to the substrate surface.

6. The method of claim 1 wherein the substrate surface is the side outer surface of a truncated conical container.

7. The method of claim 6 wherein the container is a thermoformed or molded plastic container.

* * * * *